US009181706B1

(12) United States Patent
Livers

(10) Patent No.: US 9,181,706 B1
(45) Date of Patent: Nov. 10, 2015

(54) PIVOTABLE ROOF GUTTER ASSEMBLY

(71) Applicant: Jerry T. Livers, Graham, NC (US)

(72) Inventor: Jerry T. Livers, Graham, NC (US)

( * ) Notice: Subject to any disclaimer, the term of this patent is extended or adjusted under 35 U.S.C. 154(b) by 0 days.

(21) Appl. No.: 14/494,334

(22) Filed: Sep. 23, 2014

(51) Int. Cl.

| | |
|---|---|
| ***E04D 13/064*** | (2006.01) |
| ***E04D 13/072*** | (2006.01) |
| ***E04B 1/41*** | (2006.01) |
| *E04B 1/38* | (2006.01) |

(52) U.S. Cl.
CPC ..... *E04D 13/0725* (2013.01); *E04B 1/40* (2013.01); *E04D 13/0643* (2013.01); *E04D 13/0727* (2013.01); *E04B 2001/405* (2013.01)

(58) Field of Classification Search
CPC . E04D 13/0725; E04D 13/072; E04D 13/076; E04D 13/064
See application file for complete search history.

(56) References Cited

U.S. PATENT DOCUMENTS

| | | | | | |
|---|---|---|---|---|---|
| 1,141,204 | A | | 6/1915 | Noce | |
| 1,442,771 | A | * | 1/1923 | Meunier | 248/48.1 |
| 2,219,953 | A | * | 10/1940 | Fry | 52/12 |
| 3,616,582 | A | | 11/1971 | Walek et al. | |
| 4,014,074 | A | | 3/1977 | Faye | |
| 4,019,290 | A | | 4/1977 | Manty | |
| 4,199,121 | A | * | 4/1980 | Le Febvre | 248/48.2 |
| 4,309,792 | A | | 1/1982 | Faye | |
| 4,311,292 | A | | 1/1982 | Deason | |
| 4,561,616 | A | | 12/1985 | Robinson | |
| 4,669,232 | A | | 6/1987 | Wyatt | |
| 4,705,242 | A | * | 11/1987 | Yost | 248/481 |
| 4,745,657 | A | | 5/1988 | Faye | |
| 4,813,190 | A | * | 3/1989 | Wittig | 52/11 |
| 4,837,987 | A | * | 6/1989 | Fender | 52/11 |
| 5,146,718 | A | | 9/1992 | Baskett | |
| 5,184,435 | A | | 2/1993 | Sherman | |
| 5,255,477 | A | | 10/1993 | Goodspeed | |
| 5,274,965 | A | | 1/1994 | Jackson | |
| 5,317,843 | A | * | 6/1994 | Sheehan | 52/11 |
| 5,333,417 | A | * | 8/1994 | Demartini | 52/11 |
| 5,335,460 | A | * | 8/1994 | Smith, Jr. | 52/11 |
| 5,357,719 | A | | 10/1994 | Lewis | |
| 5,649,681 | A | * | 7/1997 | Faye | 248/48.1 |
| 5,752,347 | A | | 5/1998 | Osborn | |
| 5,893,239 | A | * | 4/1999 | Leahy | 52/11 |
| 5,896,706 | A | | 4/1999 | Pike | |
| 6,219,972 | B1 | * | 4/2001 | Zusy | 52/12 |
| 6,233,876 | B1 | | 5/2001 | Obidniak | |
| 6,240,679 | B1 | * | 6/2001 | Smalara | 52/16 |
| 6,412,229 | B2 | * | 7/2002 | Kuhns | 52/13 |
| 7,581,356 | B1 | * | 9/2009 | Balkum et al. | 52/12 |
| 8,215,080 | B2 | | 7/2012 | McNeish et al. | |
| 8,234,819 | B2 | | 8/2012 | Petrov | |
| 2008/0289266 | A1 | * | 11/2008 | Kennedy | 52/97 |

* cited by examiner

*Primary Examiner* — Christine T Cajilig

(57) ABSTRACT

A pivotable gutter assembly for mounting below the bottom edge of a roof that uses a conventional gutter mounted for pivoting about a pivot axis from a normal upright position for receiving runoff from the roof to a downwardly inclined discharge position for discharge of leaves and other debris. The pivot axis is at or above the level of the rear wall of the gutter so that the rear wall can pivot rearwardly downwardly without being obstructed by the adjacent fascia of the building. The pivot axis is also located to the rear of the gutter from the center of front-to-rear weight distribution so that the gutter is urged against an attaching bracket to maintain the gutter in the normal upright position. The gutter is pivoted from the normal to the discharge position by a rod manipulated by an operator standing on the ground below the gutter.

14 Claims, 15 Drawing Sheets

PIVOTABLE ROOF GUTTER ASSEMBLY

The present invention relates to roof gutter assemblies and more particularly to a pivotally mounted roof gutter assembly that allows pivoting of the gutter to position the open top downwardly for ease of discharge of leaves and other debris.

BACKGROUND OF THE INVENTION

Cleaning leaves and other debris from roof gutters is a bothersome, and often a difficult and dangerous, but necessary, task. Conventionally, gutters are stationary and it is necessary to climb a ladder or crawl down a roof to the level of the gutter to gain access for cleaning, and repositioning along the gutter is required every few feet.

Various attempts have been made to alleviate this problem, such as covering gutters with perforated or slotted covers, which are not completely satisfactory as some water will flow over the covers without entering through the perforations or slots, especially when leaves or other debris become lodged on the covers. This problem of water flowing over the covers is particularly troublesome during heavy rain storms. Further, over time, roof materials and small debris eventually build up inside the gutters sufficiently to cause the need to remove the covers and clean out the gutters.

There have also been attempts to mount gutters so that they can be pivoted to position the open top of the gutter downwardly to discharge accumulated leaves and debris or allow cleaning of leaves and debris from below. However, none of these are known to have been commercially successful because they require significant modification of an existing gutter or involve positive manipulating mechanisms that add to the complexity and cost of installation and operation. Most of these involve hinging gutters for pivoting from either their bottom outer or inner corners, with the gutters simply hanging loosely from the bottom corners.

One known rotatable gutter system that does not involve pivoting from one of the bottom corners is disclosed in U.S. Pat. No. 5,357,719, issued Oct. 25, 1994 to Eric E. Lewis. As disclosed in this patent the gutter is mounted on a pivot rod located at or below the top of the gutter and in vertical alignment with the center of mass of the gutter. A cam is mounted on the pivot rod. A cable is attached to the cam and extends over a pulley and downwardly between the gutter and the adjacent building surface for manipulation from below. This arrangement of the pulley and cable requires undesirable spacing of the gutter from the building. Pulling on the cable causes the gutter to pivot until the front corner of the gutter is stopped against a bracket attached to and extending from the adjacent building surface. In this stopped position the open top of the gutter faces generally downwardly to discharge leaves and debris. Return of the gutter to its normal upright position is accomplished by releasing the cable, allowing the gutter to return to its upright position in which it hangs in balance by gravity without mechanical stops. Any uneven disposition of leaves and debris in the bottom of the gutter can result in a relocation of the center of mass with an undesirable displacement of the gutter from its normal upright position.

In contrast, the pivotable roof gutter assembly of the present invention utilizes an uncomplicated and inexpensive assembly for mounting a roof gutter for pivoting from a normal upright position to a downwardly facing discharge position with return to the upright position being facilitated by the weight distribution of the gutter, and with the weight distribution causing the gutter to be seated against a stop in the normal upright position.

In essence, the roof assembly of the present invention comprises a mounting over the rear wall of a gutter for pivoting the gutter about a pivot axis that is spaced rearwardly from the front-to-rear center of weight distribution so that the rear wall of the gutter is urged into a normal upright position against a stationary gutter support member, with the pivot axis also being located at a position so as to maintain clearance of the gutter from contact with the surface of the adjacent building as the rear of the gutter moves downwardly along the building surface when the gutter is pivoted to a downwardly facing discharge position. In one embodiment the weight distribution of the gutter in the discharge position is on the building side of the pivot axis, resulting in the gutter being urged and retained in the discharge position. The mounting for the gutter is attached to the side of the building. The gutter upright position stop is the stationary gutter support member, and the gutter discharge position stop may be the roof of the building.

SUMMARY OF THE INVENTION

Briefly described, the pivotable roof gutter assembly of the preferred embodiment of the present invention includes a gutter mounted below the bottom edge of a building roof. The gutter may be a conventional gutter having a bottom wall, a front wall extending upwardly from the bottom wall, a rear wall spaced from the front wall and extending upwardly from the bottom wall, with an open top extending between the front and rear walls. Optionally, the gutter may be of any other trough-like shape, such as, e.g., a segment of a circle. The gutter has a normal upright position with the open top facing upwardly for receiving water and debris runoff from the roof and a downwardly facing discharge position for discharge of leaves and other debris from the gutter A stationary gutter support member is attachable to the side of a building for extending outwardly for support the gutter for pivoting about a pivot axis from a normal upright position to a downwardly facing discharge position. The pivot axis is spaced toward the rear wall from the center of the front-to-rear weight distribution of the gutter so that the gutter will be urged into its normal upright position by the greater weight outwardly of the pivot axis. The pivot axis also is located at a position with respect to the gutter at which the adjacent building surface does not interfere with the gutter when the gutter is pivoted from its normal upright position to its downwardly facing discharge position. The station gutter support member is engageable with the gutter to prevent pivoting of the gutter rear wall upwardly along the building wall beyond its normal upright position. Preferably, a gutter discharge position stop member, such as the roof of the adjacent building, is in a position for stopping pivoting of the gutter beyond the discharge position.

In one form of the preferred embodiment of the present invention a pivoting member is attached to the gutter and the mounting member is a stationary gutter support member that extends outwardly over the pivoting member when the gutter is in its normal upright position and is attached to the pivoting member on the gutter at a pivot connection. In one form of the invention, the pivoting member of the gutter extends upwardly to the pivot connection when the gutter is in its normal upright position to a level at which the greater weight of the gutter when the gutter is in its discharge position will urge the gutter against the discharge gutter position stop member, which may be the roof of the adjacent building, while allowing the gutter to be forcibly pivoted in the opposite direction to its normal upright position. The pivot connection may be in the form of a hinge connection having a hinge pin at the pivot axis and being connected to the stationary gutter support member and to the pivoting member thereby hingedly connecting the stationary gutter support member to the pivoting member.

The stationary gutter support member may be an L-shaped bracket having a vertical leg attached to the building and a projecting leg extending for attachment to the hinge connection, and the pivoting member on the gutter may be an L-shaped bracket having a leg secured to the rear wall of the gutter and a leg extending for attachment to the front of the gutter and upon which is the hinge connection to the stationary support member. The extending leg of the pivoting member extends under the extending leg of the stationary gutter support member and is in contact therewith when the gutter in its normal upstanding position. In this arrangement, the extending leg of the stationary gutter support member serves as the stop member.

Also preferably, the gutter assembly includes an engaging element projecting outwardly from the bottom wall of the gutter adjacent the rear wall for engagement by an operating implement for pivoting of the gutter between the normal upstanding position and the downwardly facing discharge position. To maintain the gutter in downwardly facing discharge position with the open top facing downwardly, the operating implement is of a length sufficient to extend downwardly for engagement and manipulation by a person located at a level below the gutter, with the length also being sufficient, or being extendable sufficiently, for the operating implement to be temporarily seated on a surface below the gutter to hold the gutter in position for cleaning of leaves and debris from the gutter. The engaging element may be generally L-shaped with a leg secured to and projecting downwardly from the bottom wall and a leg extending transversely from the projecting leg, and the operating implement may have an outer end formed with a transverse aperture for sliding onto and off the outer leg of the engaging element.

In the situation where the roof has an interior corner, the gutter assembly includes an upright corner member mounted on and extending upwardly from the roof in the interior corner and extending along the roof from the interior corner to deflect water and debris flowing down the roof interior angle into the open top of the gutter. Preferably this upright corner member has the shape of an inverted V.

In the situation where the roof has an exterior corner, the gutter extends in both directions from adjacent the exterior corner and has end walls adjacent the exterior corner and spaced from each other sufficiently to avoid interference when the gutter is pivoted to its downwardly facing discharge position. The gutter assembly includes a fixed corner member at the exterior corner and adjacent the end walls.

BRIEF DESCRIPTION OF THE DRAWINGS

The preferred embodiment of the present invention is described herein in detail, with reference to the following figures, wherein.

DETAILED DESCRIPTION OF THE PREFERRED EMBODIMENT OF THE PRESENT INVENTION

Figure 1:
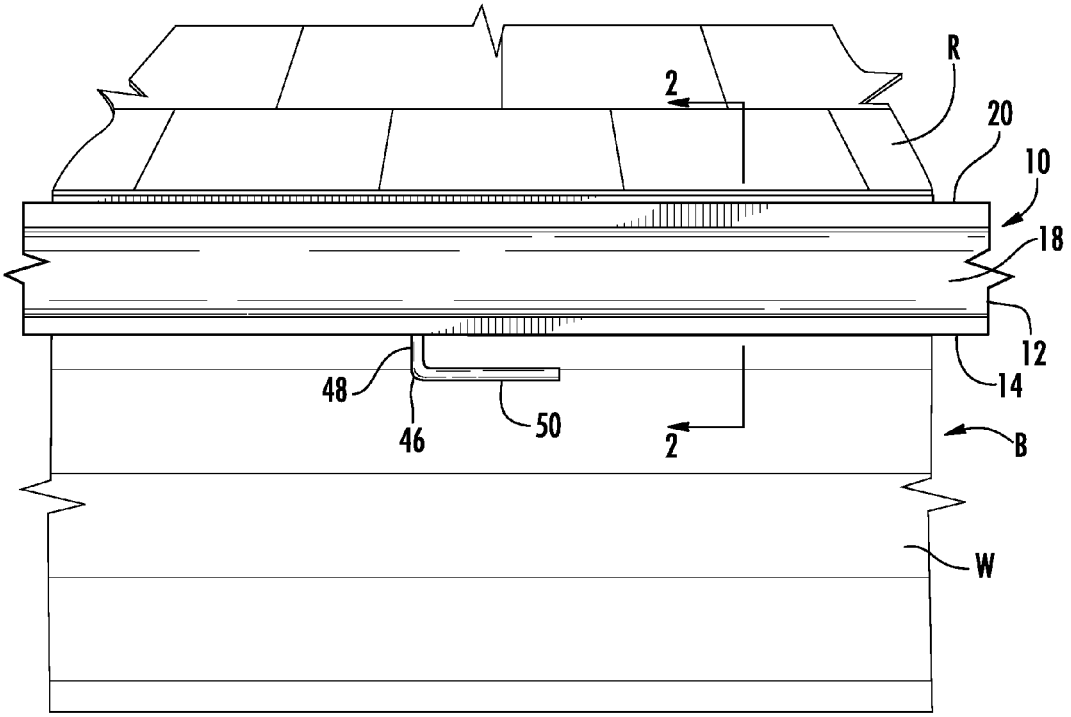
FIG. 1 is a front elevational view of a broken away-portion of the fascia board and roof of a building on which is mounted the pivotable roof gutter assembly of the preferred embodiment of the present invention, illustrating the gutter in its normal upright position.

The pivotable roof gutter system 10 of the preferred embodiment of the present invention, and as illustrated in the accompanying drawings, is attached to the fascia board F on a wall W of a building B under the overhang of a roof R.

The roof gutter system 10 includes a conventional gutter 12 having a flat bottom wall 14, a rear wall 16 extending upwardly from the bottom wall 14, a conventionally contoured front wall 18 extending upwardly from the bottom wall 14 at a spacing from the rear wall 16, and an open top 20 between the tops of the front and rear walls 18 and 16. Conventional reinforcing strips 22 extend between and are secured to the rear wall 16 and the front wall 18 at intervals along the gutter 12.

Figure 2:
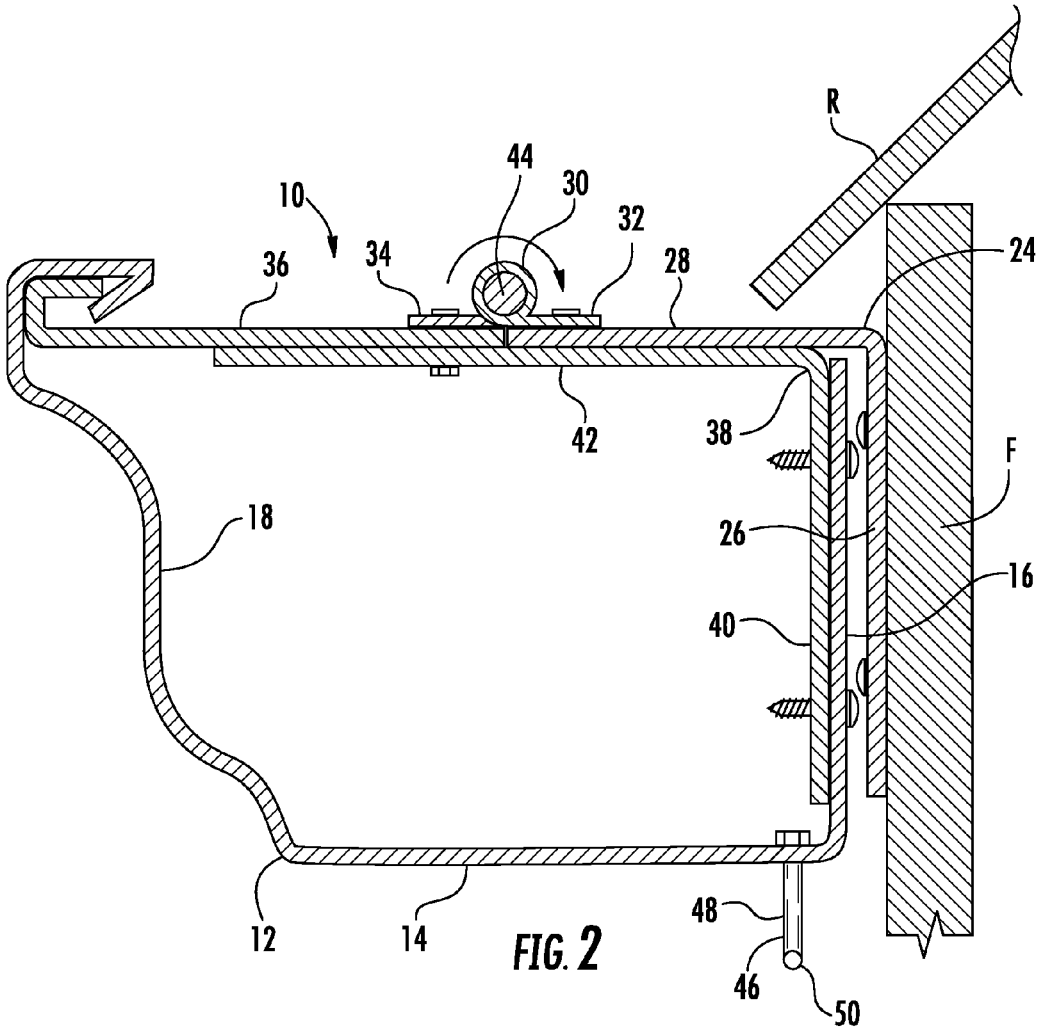
FIG. 2 is a vertical sectional view of the pivotable roof gutter assembly and adjacent building and roof of FIG. 1, taken along line 2-2 of FIG. 1.

The gutter 12 is supported on the fascia board F by rigid stationary gutter support members in the form of L-shaped brackets 24 that have vertical legs 26 secured by screws or other attaching means to the fascia board F, and have horizontal legs 28 that extend outwardly from the fascia board F below the overhang of the roof R. Hinge connections 30 are mounted on top of the outer extents of the horizontal legs 28, with a hinge plate 32 of each hinge connection 30 secured to the top of the associated horizontal leg 28 and the other hinge plate 34 attached to the top of a gutter attaching member in the form of an outer gutter supporting plate 36 that is at the same level as the horizontal leg 28 of the stationary bracket 24 when the gutter is in its normal upright position as seen in FIG. 2. The gutter supporting plates 36 extend outwardly and are secured in the inturned top of the front wall 18. The gutter attaching members include L-shaped brackets 38 having vertical legs 40 secured by screws 36 or other means to the inner surface of the gutter rear wall 16 and horizontal legs 42 extending under and secured to the underside of the outer gutter supporting plates 36. The gutter supporting plate 36, the L-shaped bracket 38, and hinge connection 30 constitute as a pivoting member. When the gutter 12 is in its normal upright position, the horizontal legs 42 of the L-shaped brackets 38 of the gutter attaching members abut against the underside of the horizontal legs 28 of the stationary brackets 24, which forms a stop for positioning the gutter 12 in its normal upright position.

With this arrangement the gutter 12 is suspended from the hinge connections 30 and is pivotable about the hinge pins 44 of the hinge connections 30 for pivoting between a normal upright position (FIG. 2) for receiving runoff from the roof and a downwardly facing discharge position (FIGS. 5 and 8) in which the open top 20 faces sufficiently downwardly to facilitate discharge of leaves and debris, in which discharge position further pivoting of the gutter 12 is prevented by abutment of the outer wall 18 of the gutter 12 against the building roof R. The hinge connections 30 are located at a position so that the gutter 12 is free to pivot in a direction in which the rear wall 16 moves downwardly along the fascia board F (clockwise in FIG. 2) free of obstruction with the fascia board F.

The hinge connections 30 are spaced toward the gutter rear wall 16 from the center of the front-to-rear weight distribution of the gutter 12 so that the greater weight distribution outwardly will urge the gutter 12 to rotate in a direction upwardly along the building B (counterclockwise in FIG. 2) for abutment of the horizontal legs 42 of the gutter brackets 38 against the underside of the horizontal legs 28 of the stationary brackets 24, with the stationary brackets 24 serving as stop members to retain gutter 12 in its normal upright position as seen in FIG. 2. An alternative stop arrangement is to have the vertical legs 26 of the brackets 24 extend upwardly, rather than downwardly, from the horizontal legs 28 and using the adjacent vertical surface of the building as a stop against which the surface of the rear wall of the gutter abuts or allow the top of the rear wall of the gutter to abut the horizontal legs 28 of the stationary brackets 24.

The weight distribution is such that forcible pivoting of the gutter 12 is required to pivot the gutter 12 from its normal upright position to a downwardly inclined discharge position and to retain it in its discharge position, although it may be possible, depending on the slant of the roof and the location of the hinge connection 30, to add sufficient weight to the outer extend of the gutter 12 so that when the gutter has been pivoted to its discharge position the greater weight distribution will be above and toward the roof from the hinge connection 30 sufficient for gravity to retain the gutter 12 in the discharge position.

To forcibly pivot the gutter 12 from its normal upright position to its discharge position, a generally L-shaped engaging element 46 is secured to the gutter bottom wall 14 adjacent the rear wall 16. This L-shaped engaging element 46 has a leg 48 secured to and projecting from the gutter bottom wall 14 and a leg 50 extending transversely from the projecting leg 48 with a free end portion for detachable sliding engagement thereon of a transverse aperture 52 at the end of an elongated operating implement, such as a rod 54, that is of a length to be manipulated by a person from below the gutter 12 to force the gutter to pivot from its normal upright position to its downwardly facing discharge position. While in the preferred embodiment illustrated the leg 48 is attached to the gutter 12 and the aperture 52 is on the end of the operating rod 54, the elements could be reversed with the engaging leg being on the rod and the aperture being on the engaging element that is attached to the gutter.

Figure 11:
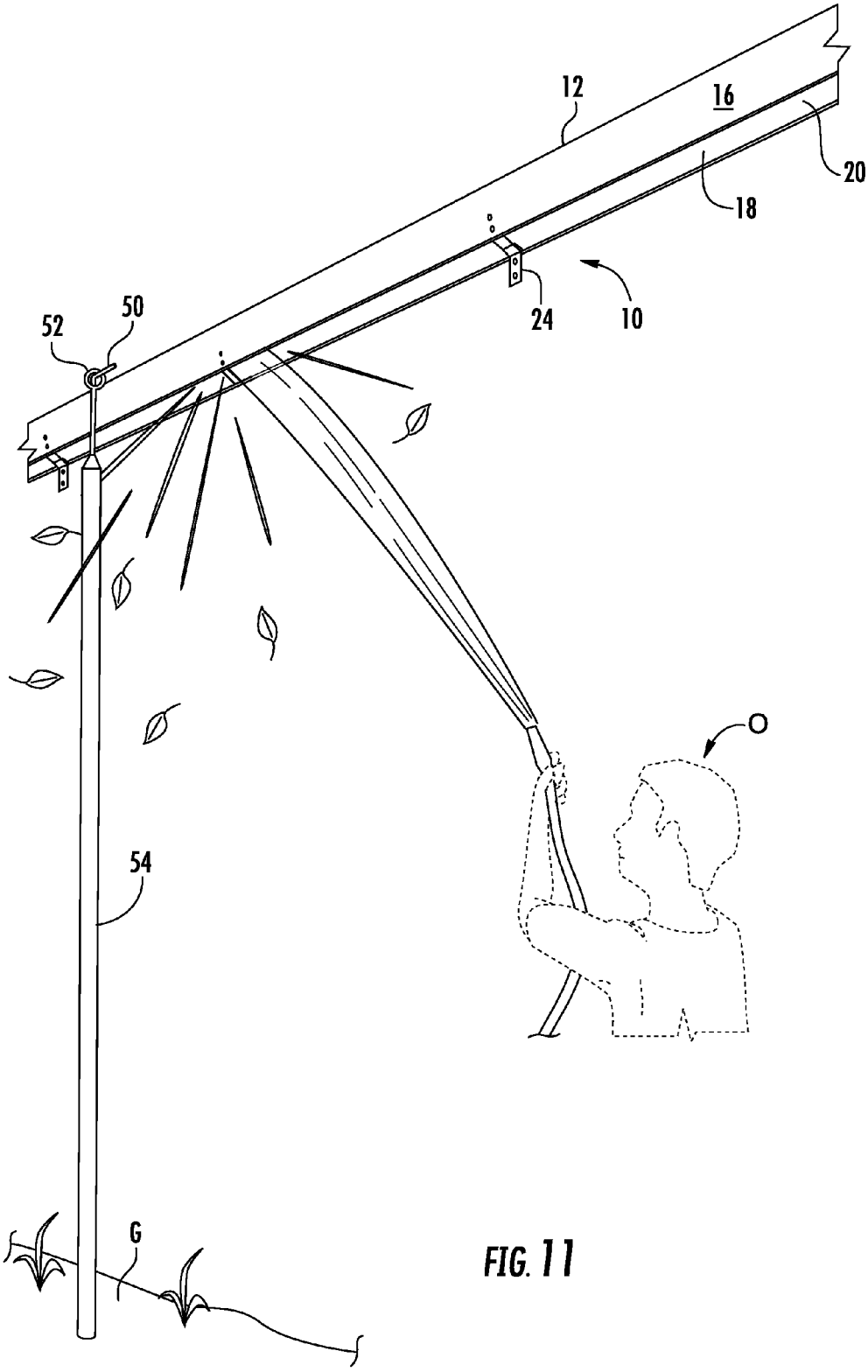
FIG. 11 is a perspective view as viewed from below the gutter in its downwardly facing discharge position, in which it is retained by the implement having its end seated against the ground, and illustrating a person standing below the gutter and washing leaves and debris from the gutter with a garden hose.

To maintain the gutter 12 in its pivoted discharge position, the elongated operating rod 54 is rigid and of a sufficient length that it can be temporarily seated on a surface, such as the ground G, below the gutter to maintain the gutter in its discharge position (FIG. 11). For this purpose, the operating rod 54 made be releasably fixable at different lengths to accommodate varying distances between the gutter 12 and the ground G, or other supporting surface, or the operating rod 54 may use removable rod segments for extending the length of the rod 54.

Figure 3:
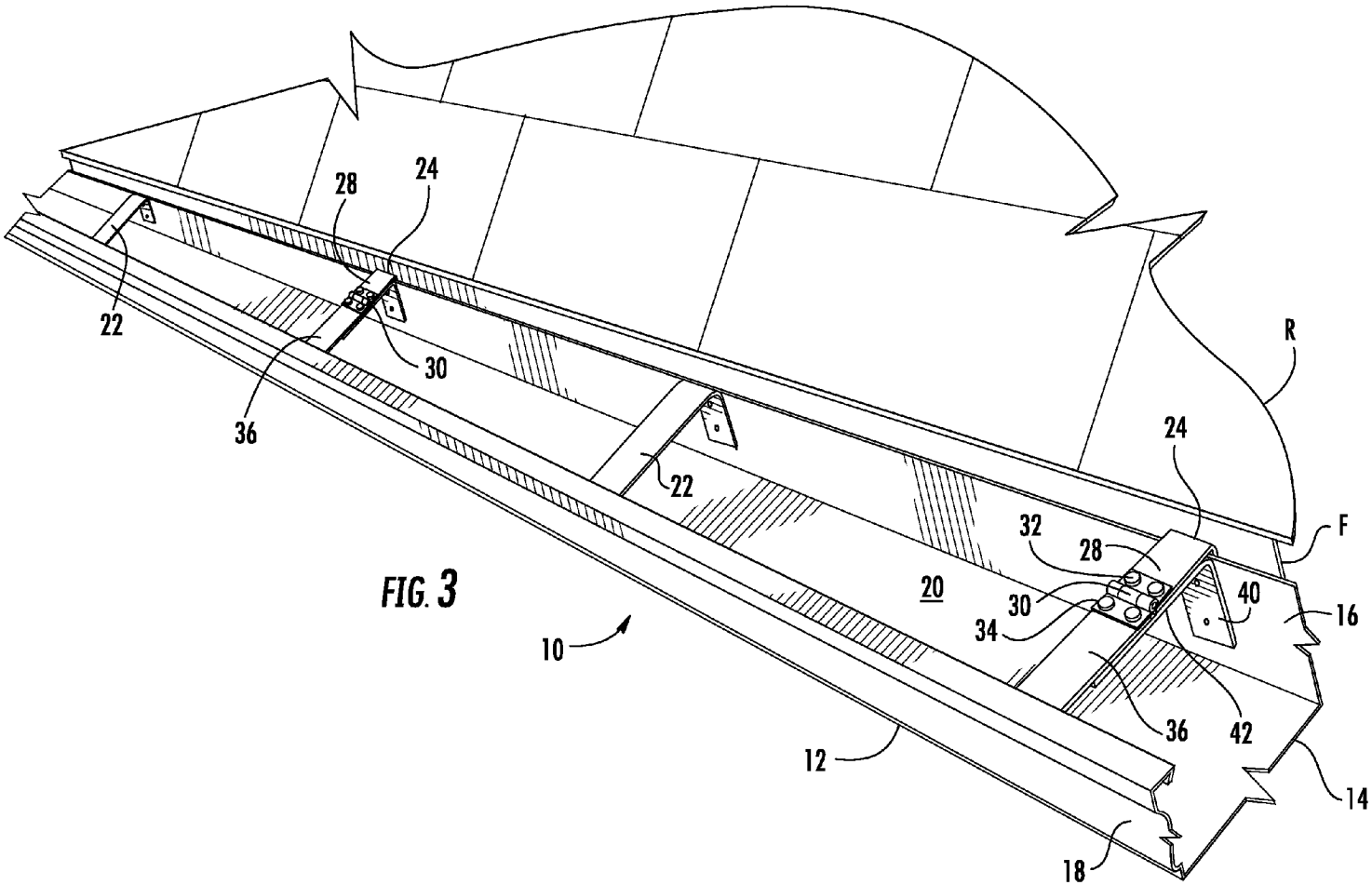
FIG. 3 is a perspective view of the roof gutter assembly and adjacent building fascia board and roof of FIG. 1, as viewed from above and outwardly from the building.
Figure 4:
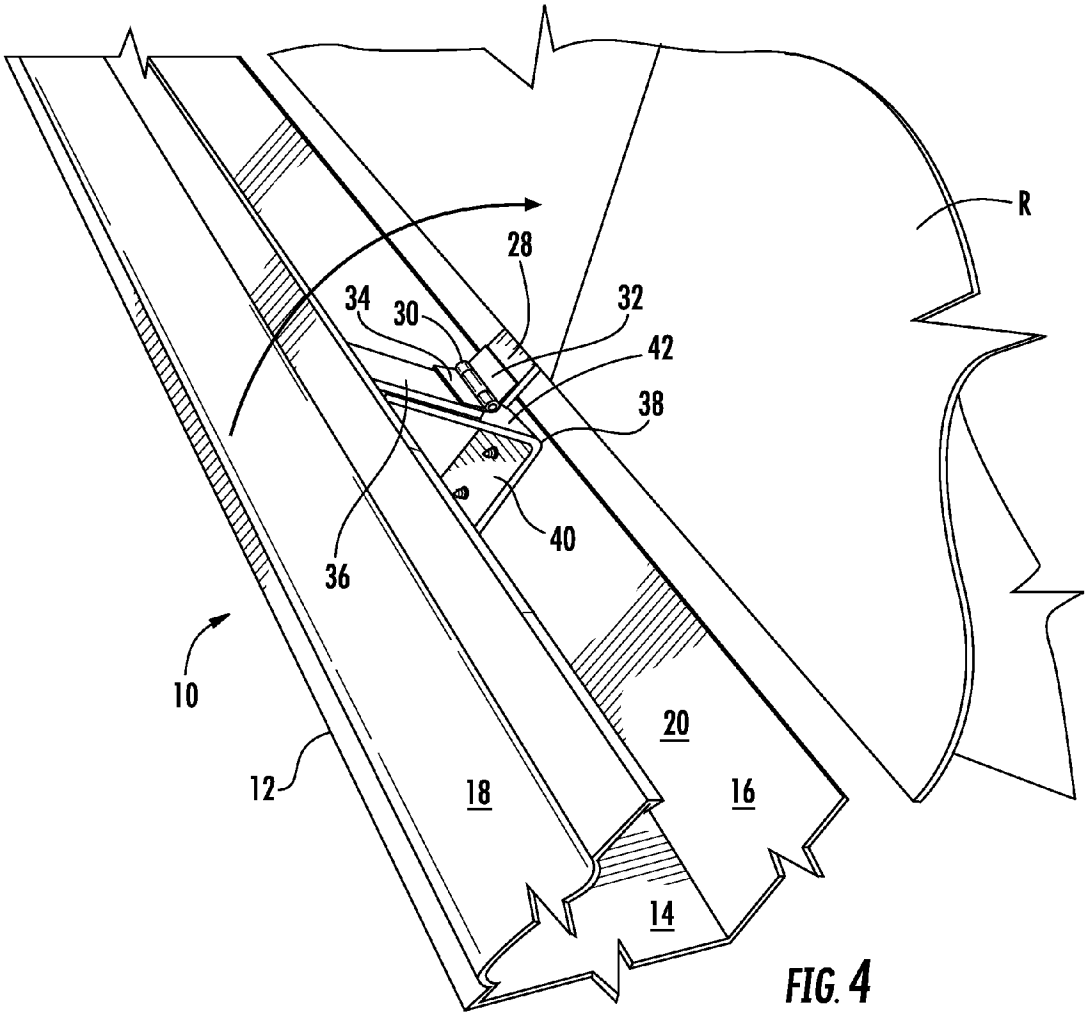
FIG. 4 is a perspective view of the roof gutter assembly and adjacent roof of FIG. 1 as viewed from above and to the right, and illustrating the gutter partially pivoted toward a downwardly facing discharge position.
Figure 5:
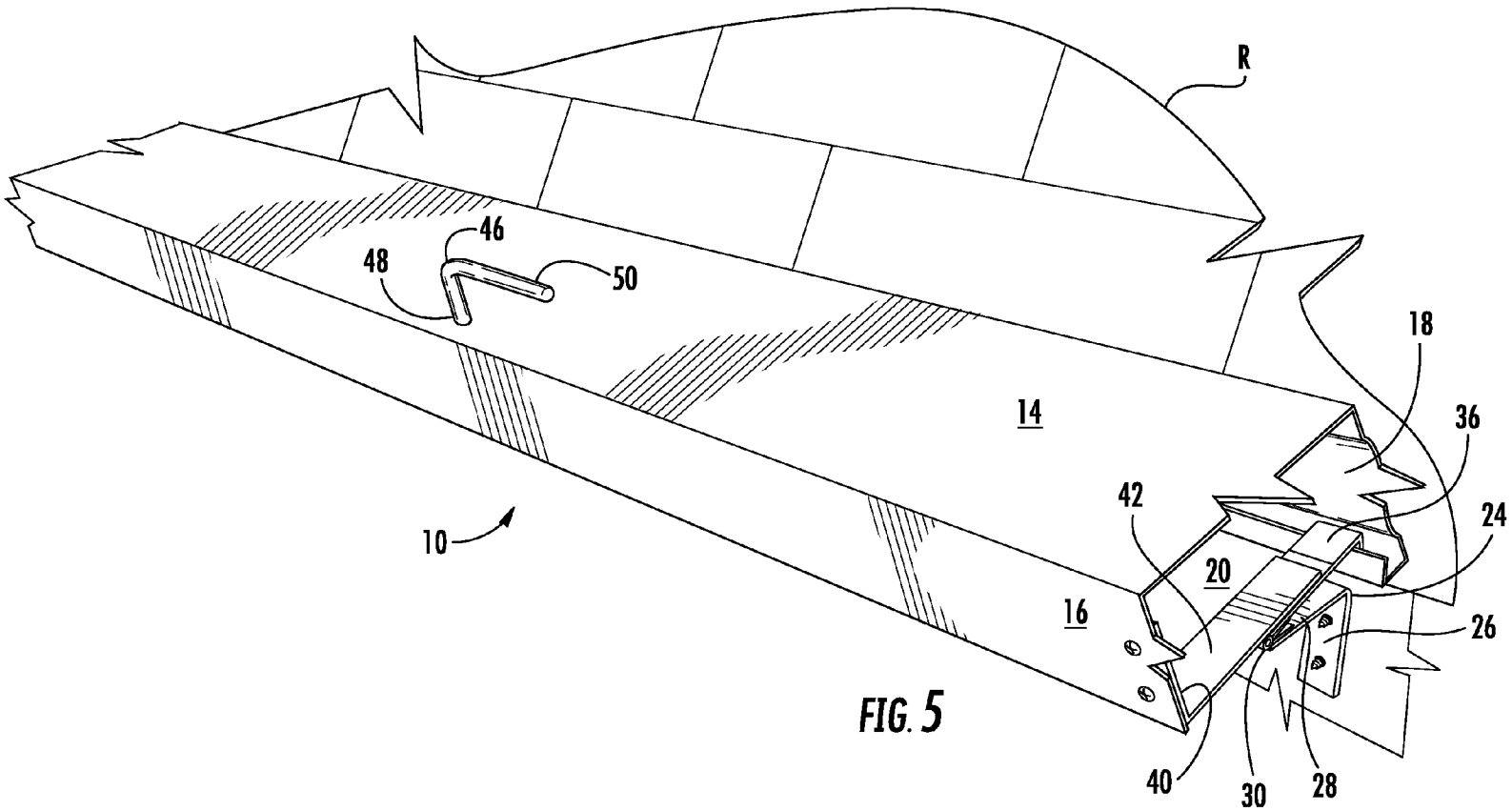
FIG. 5 is a view similar to FIG. 4, showing the gutter in its downwardly facing discharge position.
Figure 6:
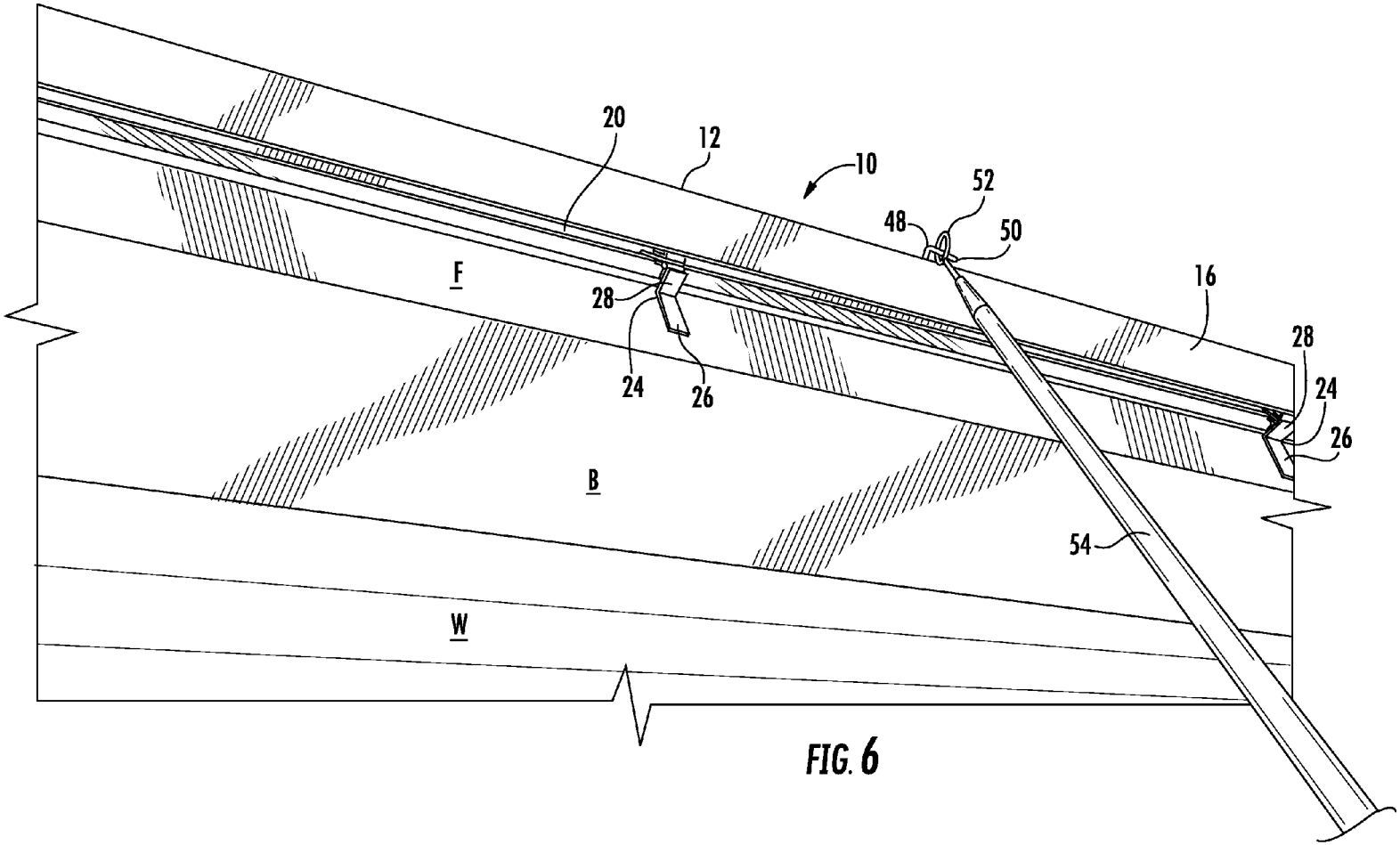
FIG. 6 is a perspective view from below and outwardly and slightly from the left of the roof gutter assembly of FIG. 1, illustrating the gutter in its downwardly facing discharge position, in which it is held by an implement that is manipulated from below the gutter.
Figure 7:
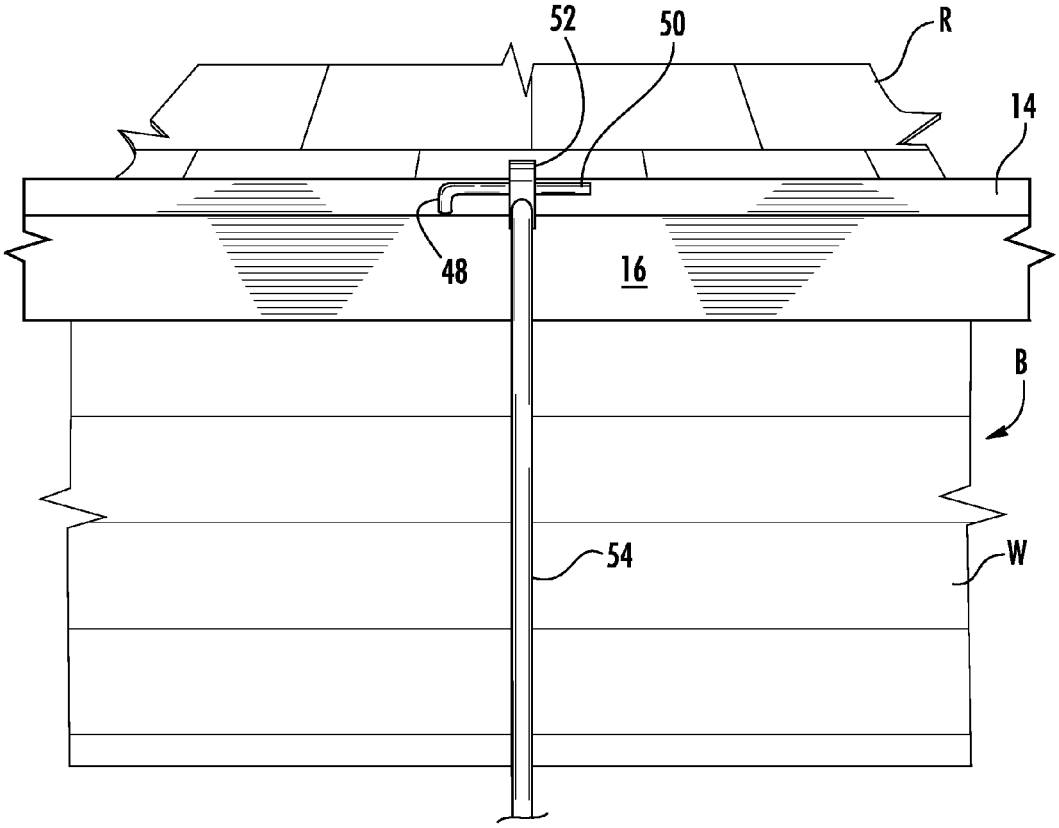
FIG. 7 is an elevational view, similar to FIG. 1, but showing the gutter in its downwardly facing discharge position, and being held in this position by an implement that is manipulated from below the gutter.
Figure 8:
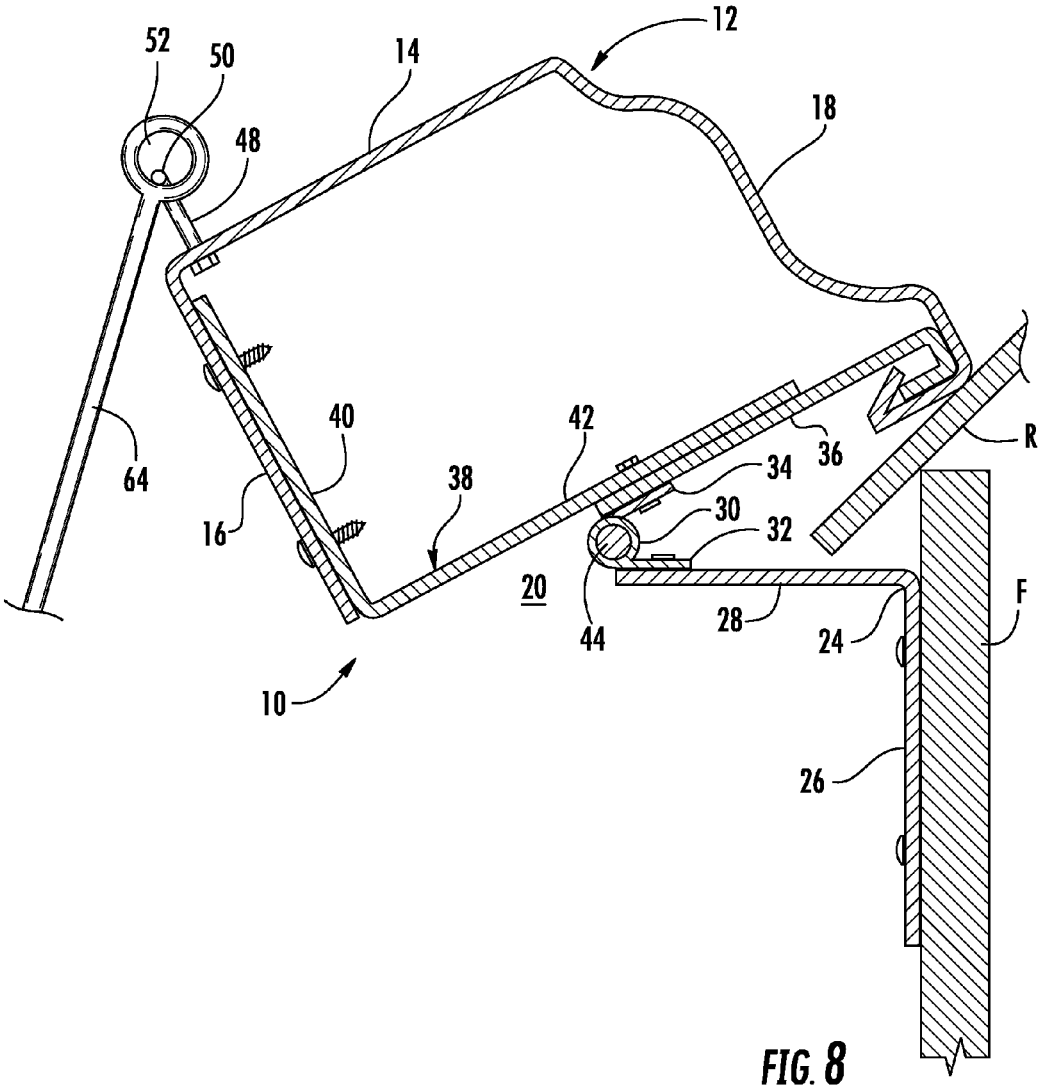
FIG. 8 is a vertical sectional view similar to FIG. 2, showing the gutter in its downwardly facing discharge position, and being held in this position by an implement that is manipulated from below the gutter.

FIG. 3 illustrates the gutter 12 in its normal upright position. FIG. 4 illustrates the gutter 12 partially pivoted toward its discharge position. FIG. 5 illustrates the gutter 12 pivoted to its discharge position. FIGS. 6, 7, and 8 illustrate the gutter 12 being maintained in its discharge position by the operating rod 54.

Figure 9:
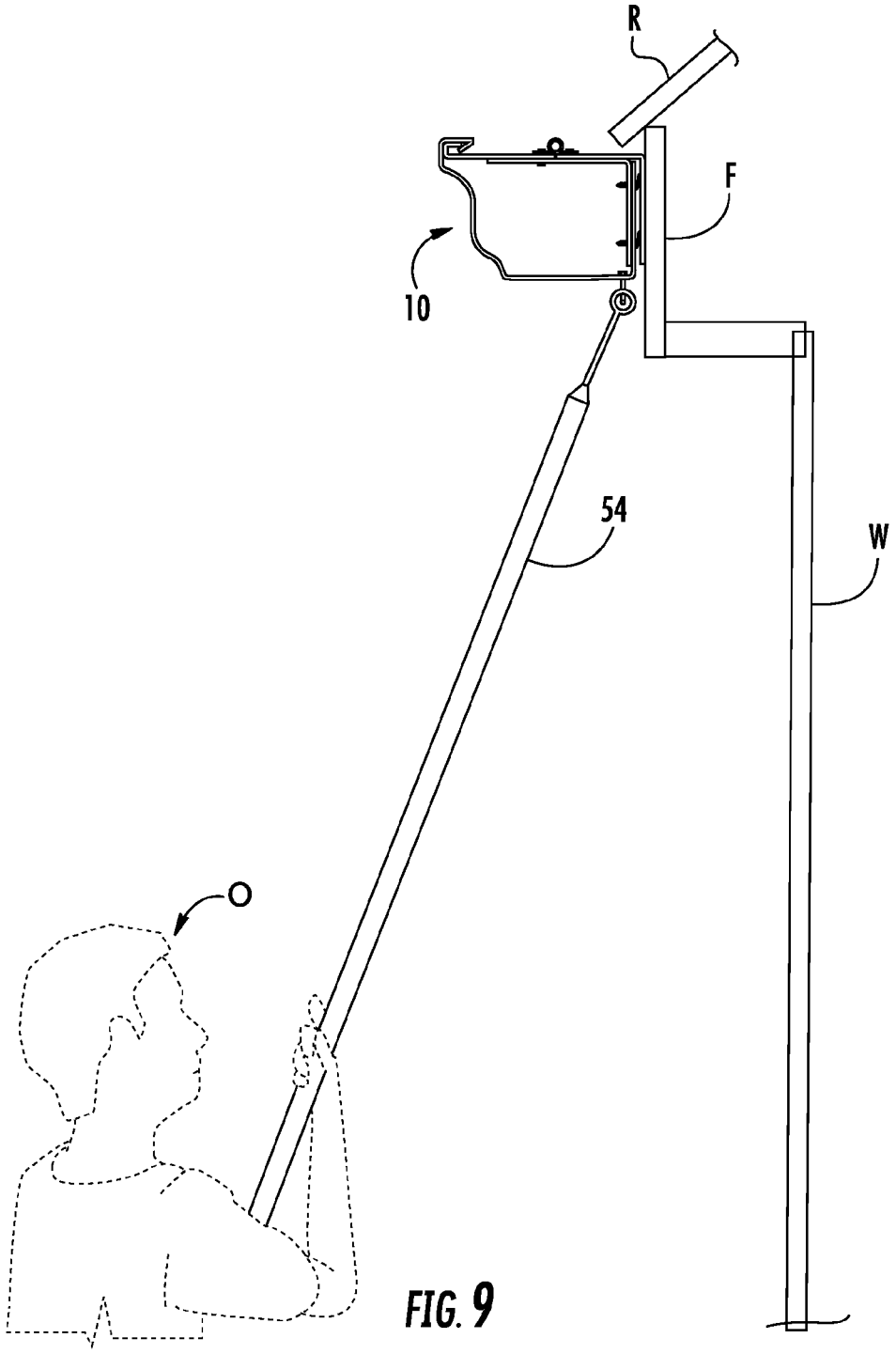
FIG. 9 is a vertical end view, partially in section, illustrating the gutter attached to a building fascia board, and under the edge of the roof, with the gutter in its normal upright position, and a person located below the gutter holding an implement engaged with a projection on the gutter.
Figure 10:
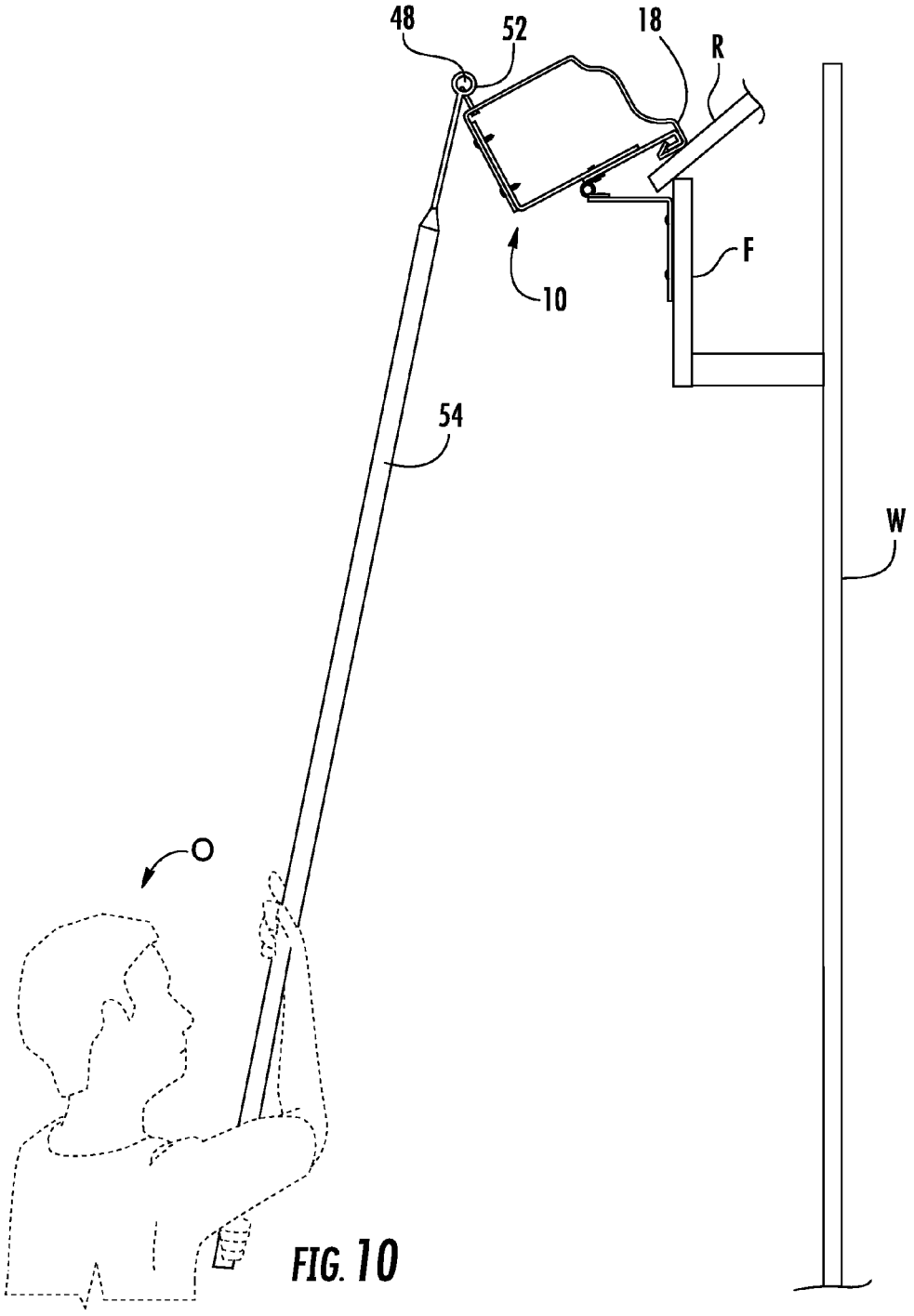
FIG. 10 is a view similar to FIG. 9 illustrating the gutter having been pivoted by manipulation of the implement into a downwardly facing discharge position.

FIG. 9 illustrates the gutter 12 in its normal upright position with an operator O below the gutter 12 having engaged the operating rod 52 with the engaging element 46 on the gutter 12. FIG. 10 illustrates the gutter 12 in its downwardly pivoted discharge position as manipulated by the operator O by the operating rod 54 attachment to the gutter 12. FIG. 11 illustrates the gutter 12 being retained in its discharge position by the engaged operating rod 54 seated on the ground G below the gutter 12, and the operator O flushing leaves and other debris from the downwardly pivoted gutter 12 with the use of a garden hose H.

Instead of using L-shaped brackets and hinge connections, the stationary bracket can be a U-shaped bracket or similar form with a base secured to the building and having parallel arms extending outwardly for support of a pivot pin there between, on which pin the pivoting member is hung for pivoting of the gutter about the pivot axis.

Figure 12A:
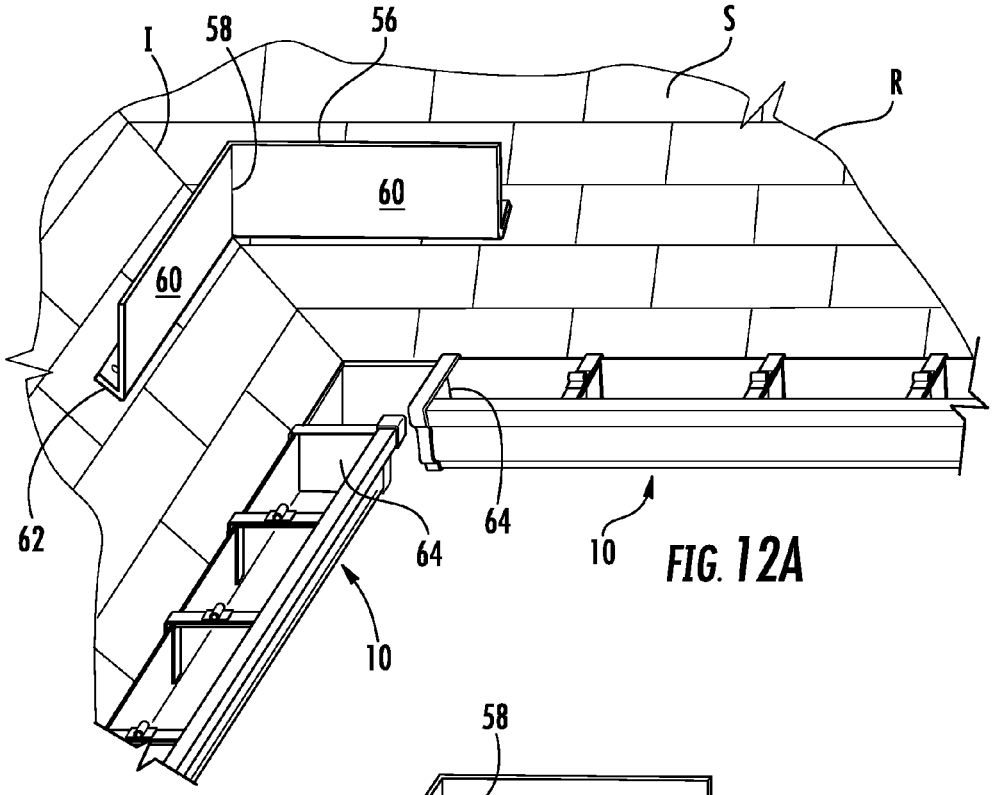
FIG. 12A is a perspective view, as viewed from above and to the left, of an interior roof angle with the roof gutter assembly of FIG. 1 in its normal upright position and with an upright corner member mounted on the roof to divert runoff from the roof into the gutter.
Figure 12B:
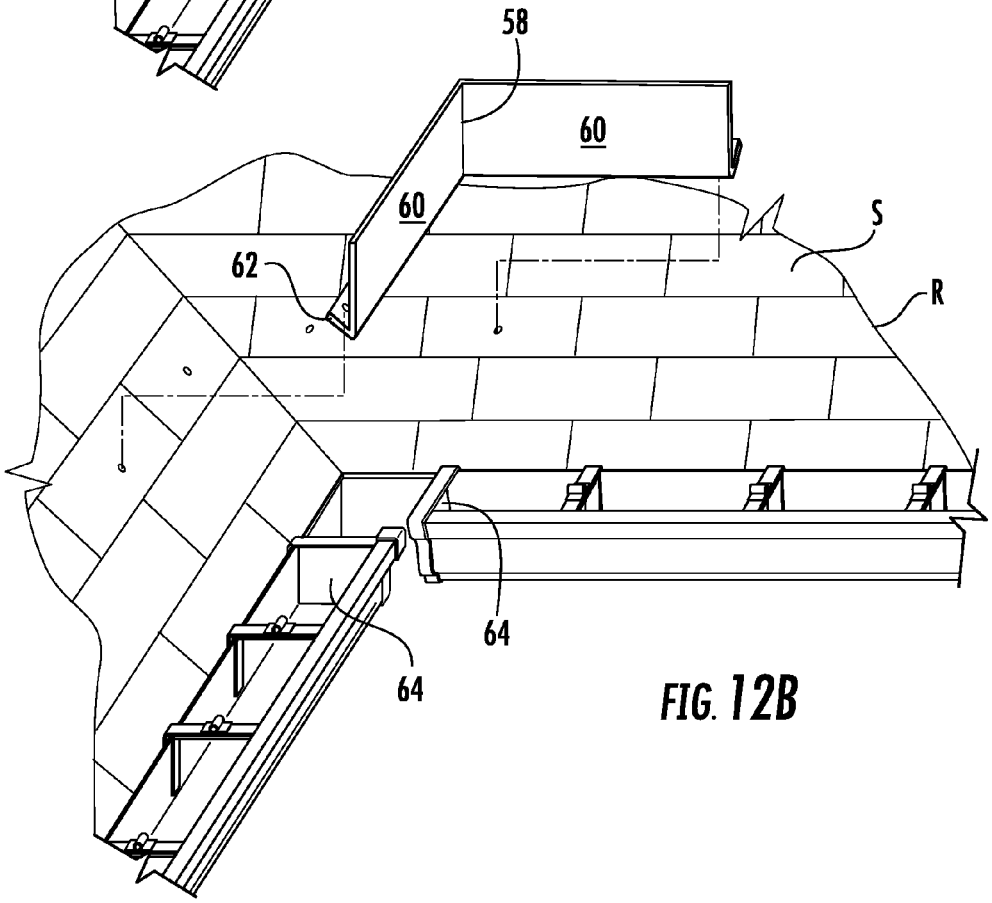
FIG. 12B is a view similar to FIG. 12A illustrating the corner member spaced above the roof prior to attachment to the roof.
Figure 13:
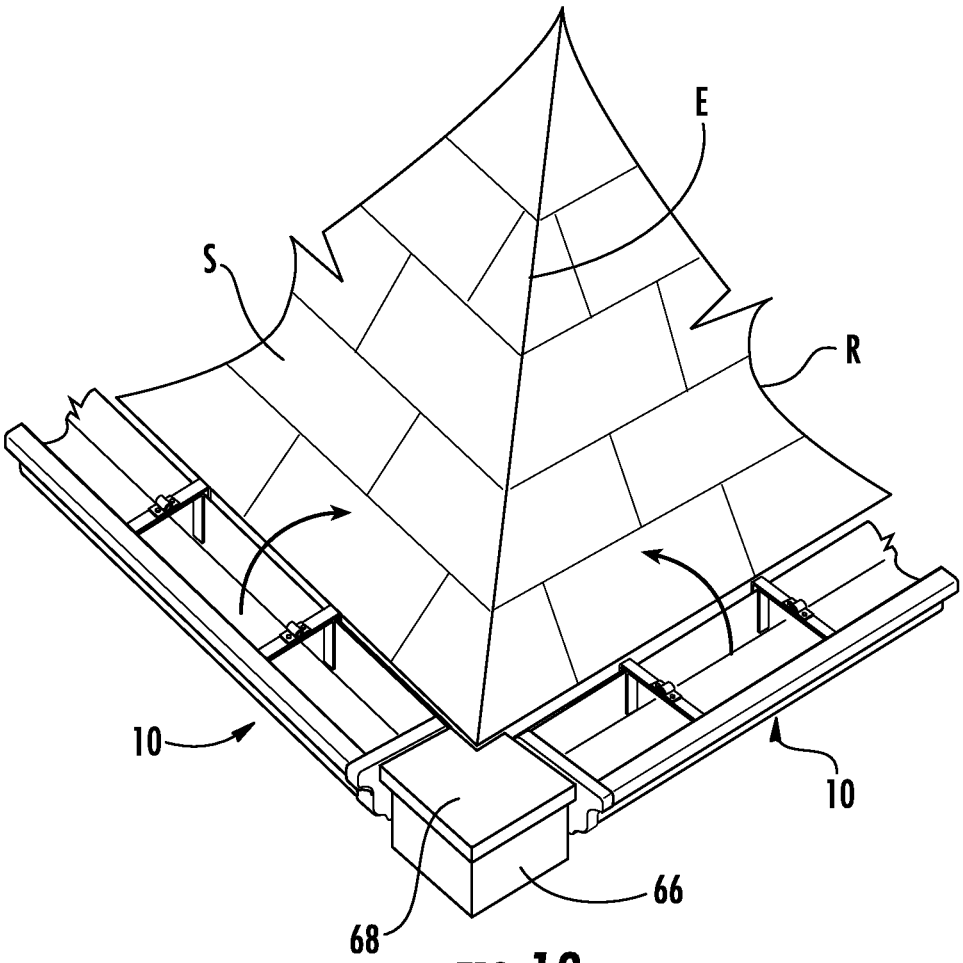
FIG. 13 is a perspective view from above and outwardly a roof gutter assembly of FIG. 1 mounted in an exterior corner angle of the roof.

When the pivotable gutter assembly 10 of the present invention is attached to a roof R that has an interior corner I (FIGS. 12A and 12B), an upright corner member 56 may be mounted on the roof R upwardly of the edge of the roof and extending along the roof R outwardly from the interior corner I to deflect water and debris flowing down the roof interior angle I into the open top 20 of the gutter 12. In the preferred embodiment, this upright corner member 56 is in the shape of an inverted V having its apex 58 in the interior and its sides 60 sloping downwardly along the roof R away from the interior corner I. Flanges 62 project from the bottom of the sides 60 at an incline for attachment by screws, nails or other attaching means to or under the shingles S of the roof F. The corner member 56 is mounted a sufficient distance upwardly along the roof R from the gutter 12 to avoid interference with pivoting of the gutter 12.

Figure 14A:
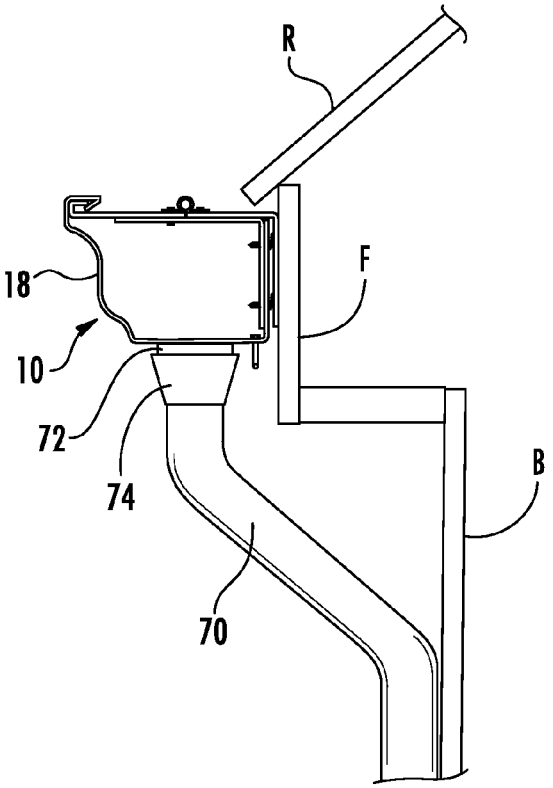
FIG. 14A is a vertical end view, partially in section, illustrating the gutter attached to a building fascia board, and under the edge of the roof, with the gutter in its normal upright position, and illustrating the location of the roof over a gutter downspout.
Figure 14B:
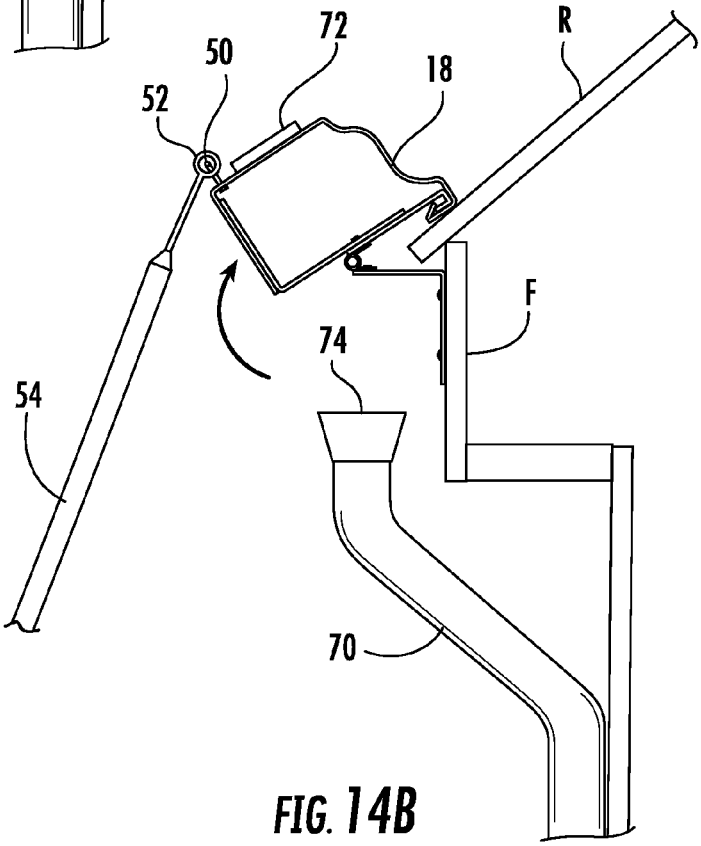
FIG. 14B is a view similar to FIG. 14A illustrating the gutter in its downwardly facing discharge position.

When the pivotable gutter assembly 10 of the present invention is attached to a roof R that has an exterior corner E, the gutter 12 extends in both directions from adjacent the exterior corner E and has end walls 64, which are spaced apart sufficiently to avoid interference when pivoted to the discharge position. A fixed corner member 66 having a flat square top 68 is mounted in the corner adjacent the end walls 64 of the gutter 12.

as illustrated in FIGS. 14A and 14B the gutter in its normal upright position 12 receives runoff from the roof R and has enough pitch to direct the runoff to downspouts 70 at which the bottom wall 14 of the gutter 12 has openings 72 and the downspouts 70 have flared openings 74 for the flow of runoff from the gutter 12 into the downspouts 70, with the downspouts 70 spaced slightly below the gutters 12 so as not to interfere with pivoting of the gutter 12 from its normal upright position to its downwardly discharging position.

Figure 15:
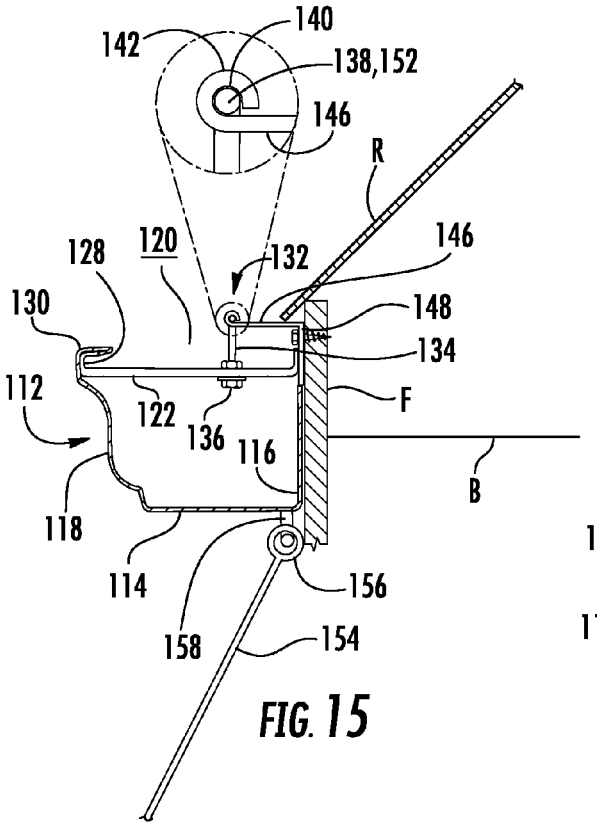
FIG. 15 is a sectional view of an alternate embodiment of the pivotable roof gutter assembly of the present invention illustrating the gutter in its normal upright position.
Figure 16:
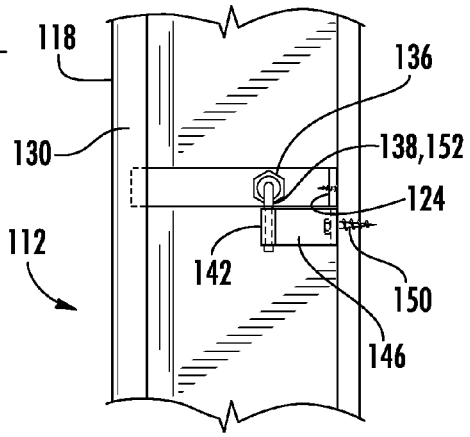
FIG. 16 is a plan view of the embodiment of FIG. 15.
Figure 17:
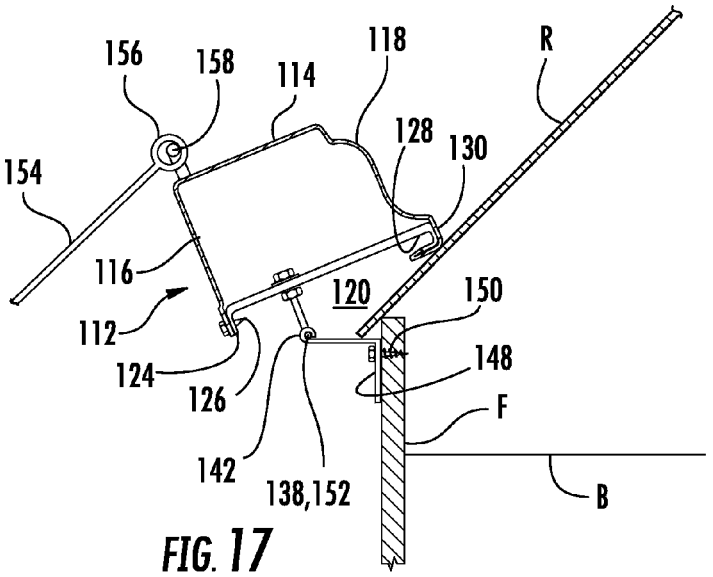
FIG. 17 is a sectional view similar to FIG. 15, but showing the gutter in its downwardly facing discharge position.

Another embodiment of the pivotable roof gutter assembly of the present invention is illustrated in FIGS. 15, 16, and 17. In this embodiment the gutter 112 is the same as the gutter 12 of the embodiment of FIGS. 1-14, having a bottom wall 114, a rear wall 116 a front wall 118 and an open top 120. In this embodiment the flat metal reinforcing strips 122 that are conventionally attached across the gutters 112 are used as the attaching members described above. These reinforcing strips 122 have upturned inner ends 124 secured by screws 126 to the rear wall 116 of the gutter 112, and outer ends 128 secured in the inturned upper ends 130 of the front wall 118 of the gutter 112. L-shaped support rods 132 have upwardly extending vertical legs 134 secured by nuts 136 to the strips 122 at locations rearward of the center of the front-to-rear distribution of the weight of the gutter 112. The rods 132 have horizontally extending outer legs 138 that extend parallel with the gutter 112 at a spacing above the reinforcing strips 122. These transversely extending legs 138 serve as pivot pins, which are seated in bearing apertures 140 in the outer ends 142 of horizontal legs 144 of L-shaped flat metal gutter supporting members 146 that have downwardly extending vertical legs 148 secured by screws 150 to the facia board F of the adjacent building B.

The location of the pivot pins 138 and corresponding pivot axes 152 rearwardly of the center of the front-to-rear weight distribution of the gutter results in the greater weight of the gutter 112 outwardly of the pivot axes 152 urging the gutter 112 to pivot against the facia board F to stop the gutter 112 in a normal upright position (FIGS. 15 and 16), from which position it can be forcibly pivoted away from the building.

The elevated location of the pivot axes 152 results in the gutter 112 being elevated when pivoted to its discharge position (FIG. 17) so that the gutter 112 can pivot sufficiently for the greater weight of the gutter 112 to be on the roof side of the pivot axes 152, causing the gutter 112 to remain by gravity in its downwardly facing discharge position until forcibly pivoted back toward it's normal upright position.

Similar to the forced pivoting of the gutter 12 of the embodiment described in FIGS. 1-14, the gutter 112 of this embodiment is forcibly pivoted manually from below the gutter 112 by a similar elongate implement 154 having an apertured end 156 removably engageable with an L-shaped projection 158 on the bottom wall 114 adjacent the rear wall 116. However, with this embodiment the weight of the gutter 112 inwardly of the pivot axes 152 and the height of the pivot axes 152 above the gutter 112 results in the gutter 112 resting in the discharge position by gravity without the need for the implement 154, which then need not be of a length or an adjustable length as required with the embodiment of FIGS. 1-14. In some applications, depending on the vertical distance of the pivot axes 152 above the gutter 112 and the slant of the roof R, the weight may not be distributed to retain the gutter 112 in the discharge position, but regardless of the weight distribution, the simplicity of the structure of this embodiment is advantageous.

In view of the aforesaid written description of the present invention it will be readily understood by those skilled in the art that the present invention is susceptible of broad utility and application in many embodiments and adaptations other than those herein described. Many variations and modifications will be apparent from or reasonably suggested by the present invention and foregoing description thereof without departing from the substance or scope of the present invention. Accordingly, while the present invention has been described herein in detail in relation to preferred embodiments it is to be understood that this disclosure is only illustrative of examples of the present invention made merely for purposes of providing a full and enabling disclosure of the invention. The foregoing disclosure is not intended nor is it to be construed to limit the present invention or otherwise exclude any other embodiment, adaptations, variations, modifications, and equivalent arrangements, the present invention being limited only by the scope of the claims appended hereto and equivalents thereof.

What is claimed is:

1. A pivotable gutter assembly for mounting below the bottom edge of a roof, said assembly comprising:

a gutter having:

a bottom wall;

a front wall extending upwardly from said bottom wall;

a rear wall spaced from said front wall and extending upwardly from said bottom wall;

an open top between said front and rear walls;

said gutter having a normal upright position with said open top facing upwardly for receiving water and debris runoff from the roof;

a stationary gutter support member attachable to the side of a building and extending outwardly over said rear wall of said gutter for support of said gutter for pivoting said gutter about a pivot axis from a normal upright position to a downwardly facing discharge position, said pivot axis being spaced toward said rear wall from the center of the front-to-rear weight distribution of said gutter so that when said gutter is in its normal upright position the greater weight outwardly of said pivot axis urges said gutter to pivot to its normal upright position against said stationary support member, and said pivot axis being located at a position with respect to said gutter at which the adjacent side of the building does not interfere with the gutter when the gutter is pivoted from its normal upright position to its downwardly facing discharge position, and said pivot axis allowing said rear wall of said gutter to be forcibly pivoted downardly from its normal position to facilitate discharge of leaves and debris; and a pivoting member which attaches to said gutter and to said stationary gutter support member.

2. A pivotable gutter assembly according to claim 1, wherein said stationary gutter support member is a normal gutter position stop member.

3. A pivotable gutter assembly according to claim 1, characterized further in that said pivoting member attached to said gutter is pivotally attached to said stationary gutter support member at said pivot axis.

4. A pivotable gutter assembly according to claim 3 characterized further in that said pivoting member is secured to said front and said rear walls of said gutter.

5. A pivotable gutter assembly according to claim 1, and characterized further in that said station gutter support member is rigid for supporting the weight of said gutter.

6. A pivotable gutter assembly according to claim 1 and characterized further in that said stationary gutter support member is an L-shaped bracket having a vertical leg attached to the side of a building, and a projecting leg extending from said vertical leg for attachment to said pivoting member at said pivot axis.

7. A pivotable gutter assembly for mounting below the bottom edge of a roof, said assembly comprising:

a gutter having:

a bottom wall;

a front wall extending upwardly from said bottom wall;

a rear wall spaced from said front wall and extending upwardly from said bottom wall;

an open top between said front and rear walls;

said gutter having a normal upright position with said open top facing upwardly for receiving water and debris runoff from the roof;

a stationary gutter support member attachable to the side of a building and extending outwardly over said rear wall of said gutter for support of said gutter for pivoting said gutter about a pivot axis from a normal upright position to a downwardly facing discharge position, said axis being spaced toward said rear wall from the center of the front-to-rear weight distribution of said gutter so that when said gutter is in its normal upright position the greater weight outwardly of said pivot axis urges said gutter to pivot to its normal upright position against said stationary support member, and said pivot axis being located at a position with respect to said gutter at which the adjacent side of the building does not interfere with the gutter when the gutter is pivoted from its normal upright position to its downwardly facing discharge position, and said pivot axis allowing said rear wall of said gutter to be forcibly pivoted downwardly from its normal position to facilitate discharge of leaves and debris;

a pivoting member which attaches to said gutter and to said stationary gutter support member; and an engaging element projecting outwardly from said bottom wall for disengageable engagement by an operating implement for pivoting of said gutter to position said open top downwardly.

8. A pivotable gutter assembly according to claim 7, and characterized further in that said engaging element projects outwardly from said bottom wall adjacent said rear wall.

9. A pivotable gutter assembly according to claim 7, and characterized further in that said operating implement is of a length sufficient to extend downwardly for engagement and manipulation by a person located at a level below said gutter.

10. A pivotable gutter assembly according to claim 9, and characterized further in that said operating implement is adjustable to a length sufficient for the operating implement to be temporarily seated on a surface below said gutter to hold said gutter in said discharge position for facilitating discharge of debris.

11. A pivotable gutter assembly according to claim 7, and characterized further in that one of said engaging element and said operating implement has an outer transversely extending free end portion and the other one of said engaging element and said implement has an end formed with a transverse opening for removably engaging said outer end portion, thereby connecting said engaging element and operating implement for pivoting of said gutter.

12. A pivotable gutter assembly according to claim 1, and characterized further in that said roof has an interior corner and said gutter assembly includes an upright corner member mounted on an extending upwardly from said roof in said interior corner and extending along said roof from said interior corner to deflect water and debris flowing down said roof interior angle into said open top of said gutter, said upright corner member being mounted on said roof a sufficient distance from said gutter to avoid interference with pivoting of the gutter.

13. A pivotable gutter assembly according claim 12, and characterized further in that said uptight corner member has the shape of an inverted V, having its apex in said interior corner and its sides sloping downwardly along said roof away from said interior corner.

14. A pivotable gutter assembly according to claim 1, characterized further in that said roof has an exterior corner, said gutter extends in both directions from adjacent said exterior corner and has end walls adjacent said exterior corner, said gutter assembly includes a fixed corner member at said exterior corner and adjacent said end walls.

* * * * *